US008602518B2

(12) United States Patent
Mizes et al.

(10) Patent No.: US 8,602,518 B2
(45) Date of Patent: Dec. 10, 2013

(54) TEST PATTERN EFFECTIVE FOR COARSE REGISTRATION OF INKJET PRINTHEADS AND METHODS OF ANALYSIS OF IMAGE DATA CORRESPONDING TO THE TEST PATTERN IN AN INKJET PRINTER

(75) Inventors: Howard A. Mizes, Pittsford, NY (US); Michael C. Mongeon, Walworth, NY (US); Helen HaeKyung Shin, Fairport, NY (US); Yeqing Zhang, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 309 days.

(21) Appl. No.: 12/754,730

(22) Filed: Apr. 6, 2010

(65) Prior Publication Data

US 2011/0242186 A1 Oct. 6, 2011

(51) Int. Cl.
*B41J 29/393* (2006.01)

(52) U.S. Cl.
USPC ..... 347/19

(58) Field of Classification Search
USPC ..... 347/19; 345/5
See application file for complete search history.

(56) References Cited

U.S. PATENT DOCUMENTS

| | | | |
|---|---|---|---|
| 4,401,024 | A | 8/1983 | Frentress |
| 4,675,696 | A | 6/1987 | Suzuki |
| RE32,967 | E | 6/1989 | St. John et al. |
| 4,887,530 | A | 12/1989 | Sainio |
| 5,325,159 | A | 6/1994 | Day |
| 5,343,231 | A | 8/1994 | Suzuki |
| 5,451,990 | A | 9/1995 | Sorenson et al. |
| 5,539,498 | A | 7/1996 | De Cock et al. |
| 5,600,350 | A | 2/1997 | Cobbs et al. |
| 5,796,414 | A | 8/1998 | Sievert et al. |
| 5,887,236 | A | 3/1999 | Hirao et al. |
| 5,992,973 | A | 11/1999 | Wen |
| 6,049,680 | A | 4/2000 | Goris et al. |
| 6,072,587 | A | 6/2000 | Hicks |
| 6,076,915 | A | 6/2000 | Gast et al. |
| 6,089,693 | A | 7/2000 | Drake et al. |

(Continued)

FOREIGN PATENT DOCUMENTS

EP 0 895 869 A2 2/1999

OTHER PUBLICATIONS

Office Action for U.S. Appl. No. 12/754,867, mailed Apr. 9, 2012, United States Patent and Trademark Office (7 pages).

(Continued)

*Primary Examiner* — Julian Huffman
*Assistant Examiner* — Sharon A Polk
(74) *Attorney, Agent, or Firm* — Maginot, Moore & Beck, LLP

(57) ABSTRACT

A test pattern printed by printheads in an inkjet printer enables image analysis of the test pattern that identifies positions of the printheads and the inkjets operating in the printheads. The test pattern includes a plurality of arrangements of dashes, each arrangement of dashes having a predetermined number of rows and a predetermined number of columns, each dash in a row of dashes in the arrangement of dashes being separated by a first predetermined distance and each dash in a column of dashes in the arrangement of dashes being separated by a second predetermined distance, each dash in a column of an arrangement of dashes being ejected by a single inkjet ejector in a printhead of the inkjet printer, and a plurality of unprinted areas interspersed between the plurality of arrangements of dashes.

20 Claims, 10 Drawing Sheets

(56) References Cited

U.S. PATENT DOCUMENTS

| | | | | |
|---|---|---|---|---|
| 6,109,722 | A * | 8/2000 | Underwood et al. | 347/19 |
| 6,196,652 | B1 | 3/2001 | Subirada et al. | |
| 6,266,437 | B1 | 7/2001 | Eichel et al. | |
| 6,275,600 | B1 | 8/2001 | Banker et al. | |
| 6,278,467 | B1 * | 8/2001 | Kuwajima et al. | 345/531 |
| 6,300,968 | B1 | 10/2001 | Kerxhalli et al. | |
| 6,334,720 | B1 | 1/2002 | Kato et al. | |
| 6,352,331 | B1 | 3/2002 | Armijo et al. | |
| 6,377,758 | B1 | 4/2002 | OuYang et al. | |
| 6,467,867 | B1 | 10/2002 | Worthington et al. | |
| 6,494,558 | B1 | 12/2002 | Doval et al. | |
| 6,554,390 | B2 | 4/2003 | Arquilevich et al. | |
| 6,637,853 | B1 | 10/2003 | Ahne et al. | |
| 6,639,669 | B2 | 10/2003 | Hubble, III et al. | |
| 6,655,771 | B2 * | 12/2003 | Matsumoto et al. | 347/13 |
| 6,847,465 | B1 | 1/2005 | Wetchler et al. | |
| 6,883,892 | B2 | 4/2005 | Sievert et al. | |
| 6,942,313 | B2 | 9/2005 | Kanda | |
| 6,993,275 | B2 | 1/2006 | Mitsuya et al. | |
| 7,073,883 | B2 | 7/2006 | Billow | |
| 7,118,188 | B2 | 10/2006 | Vilanova et al. | |
| 7,216,948 | B2 | 5/2007 | Matsuzaki et al. | |
| 7,254,254 | B2 | 8/2007 | Ueda et al. | |
| 7,309,118 | B2 * | 12/2007 | Mizes et al. | 347/19 |
| 7,380,897 | B2 | 6/2008 | Anderson et al. | |
| 7,390,073 | B2 | 6/2008 | Bailey et al. | |
| 7,391,525 | B2 | 6/2008 | Chapman et al. | |
| 7,478,894 | B2 | 1/2009 | Kim et al. | |
| 7,515,305 | B2 | 4/2009 | Mizes | |
| 7,549,721 | B2 | 6/2009 | Nakano et al. | |
| 7,552,986 | B2 | 6/2009 | Mizes et al. | |
| 7,584,699 | B2 | 9/2009 | Ford | |
| 7,607,752 | B2 | 10/2009 | Childers et al. | |
| 7,630,519 | B2 | 12/2009 | Nagarajan | |
| 7,630,653 | B2 | 12/2009 | Bonino | |
| 7,637,586 | B2 | 12/2009 | Yun | |
| 7,647,018 | B2 | 1/2010 | Moore et al. | |
| 7,686,298 | B2 | 3/2010 | Fioravanti et al. | |
| 2002/0131800 | A1 | 9/2002 | Jacob et al. | |
| 2002/0135629 | A1 | 9/2002 | Sarmast et al. | |
| 2003/0082360 | A1 | 5/2003 | O'Donnell et al. | |
| 2003/0231350 | A1 | 12/2003 | Yamagishi | |
| 2004/0160468 | A1 | 8/2004 | Kim et al. | |
| 2005/0099447 | A1 | 5/2005 | Hsu et al. | |
| 2006/0060709 | A1 * | 3/2006 | Thal | 244/135 A |
| 2006/0072939 | A1 | 4/2006 | Kremer et al. | |
| 2006/0109329 | A1 | 5/2006 | Holtman et al. | |
| 2006/0109330 | A1 | 5/2006 | Holtman | |
| 2006/0114302 | A1 | 6/2006 | Holtman | |
| 2006/0158476 | A1 * | 7/2006 | Ng et al. | 347/19 |
| 2008/0062219 | A1 | 3/2008 | Mizes et al. | |
| 2008/0124158 | A1 | 5/2008 | Folkins et al. | |
| 2009/0015621 | A1 * | 1/2009 | Hirota et al. | 347/19 |
| 2009/0085952 | A1 * | 4/2009 | Yamazaki | 347/19 |
| 2009/0265950 | A1 | 10/2009 | Mizes et al. | |
| 2009/0293750 | A1 | 12/2009 | Haenni et al. | |
| 2009/0322849 | A1 | 12/2009 | Calamita et al. | |
| 2010/0013882 | A1 | 1/2010 | Mizes et al. | |
| 2010/0220138 | A1 * | 9/2010 | Nakata et al. | 347/14 |
| 2010/0303281 | A1 * | 12/2010 | Wu et al. | 382/100 |
| 2011/0141175 | A1 * | 6/2011 | Murray et al. | 347/14 |
| 2011/0187777 | A1 * | 8/2011 | Shin et al. | 347/14 |
| 2012/0056928 | A1 | 3/2012 | Powers et al. | |
| 2012/0155894 | A1 | 6/2012 | Kim et al. | |

OTHER PUBLICATIONS

Amendment in Response to Office Action for U.S. Appl. No. 12/754,867, submitted May 1, 2012 (6 pages).

Second Office Action for U.S. Appl. No. 12/754,867, mailed Jul. 10, 2012, United States Patent and Trademark Office (7 pages).

Amendment in Response to Second Office Action for U.S. Appl. No. 12/754,867, submitted Sep. 10, 2012 (10 pages).

Office Action for U.S. Appl. No. 12/754,735, mailed Jun. 4, 2012, United States Patent and Trademark Office (6 pages).

Amendment in Response to Office Action for U.S. Appl. No. 12/754,735, submitted Aug. 6, 2012 (7 pages).

* cited by examiner

| | 1 | 2 | 3 | 4 | 5 | 6 | X PATTERN | Y1 PATTERN |
|---|---|---|---|---|---|---|---|---|
| | 1 | 1 | 1 | 1 | 1 | 1 | 00000 | HLHLHL |
| 1 MISSING JETS | 0 | 1 | 1 | 1 | 1 | 1 | 0000 | LHLHL |
| | 1 | 0 | 1 | 1 | 1 | 1 | 1000 | HHLHL |
| | 1 | 1 | 0 | 1 | 1 | 1 | 0100 | HLLHL |
| | 1 | 1 | 1 | 1 | 1 | 1 | 0010 | HLHHL |
| | 1 | 1 | 1 | 0 | 0 | 1 | 0001 | HLHLL |
| | 1 | 1 | 1 | 1 | 1 | 0 | 0000 | HLHLH |
| 2 MISSING JETS | 1 | 1 | 1 | 1 | 0 | 0 | 000 | HLHL |
| | 0 | 1 | 1 | 1 | 1 | 0 | 000 | LHLH |
| | 0 | 0 | 1 | 1 | 1 | 1 | 000 | HLHL |
| | 1 | 1 | 1 | 0 | 1 | 0 | 001 | HLHH |
| | 0 | 1 | 1 | 1 | 0 | 1 | 001 | LHLL |
| | 1 | 1 | 0 | 1 | 1 | 0 | 010 | HLLH |
| | 0 | 1 | 1 | 0 | 1 | 1 | 010 | LHHL |
| | 1 | 0 | 1 | 1 | 1 | 0 | 100 | HHLH |
| | 0 | 1 | 0 | 1 | 1 | 1 | 100 | LLHL |
| | 1 | 1 | 1 | 0 | 0 | 1 | 002 | HLHL |
| | 1 | 1 | 0 | 1 | 0 | 1 | 011 | HLLL |
| | 1 | 0 | 1 | 1 | 0 | 1 | 101 | HHLL |
| | 1 | 1 | 0 | 0 | 1 | 1 | 020 | HLHL |
| | 1 | 0 | 1 | 0 | 1 | 1 | 110 | HHHL |
| | 1 | 0 | 0 | 1 | 1 | 1 | 200 | HLLH |

FIG. 8

TEST PATTERN EFFECTIVE FOR COARSE REGISTRATION OF INKJET PRINTHEADS AND METHODS OF ANALYSIS OF IMAGE DATA CORRESPONDING TO THE TEST PATTERN IN AN INKJET PRINTER

TECHNICAL FIELD

This disclosure relates generally to identification of printhead orientation in an inkjet printer having one or more printheads, and, more particularly, to analysis of image data to identify the printhead orientation.

BACKGROUND

Ink jet printers have printheads that operate a plurality of inkjets that eject liquid ink onto an image receiving member. The ink may be stored in reservoirs located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analyze the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white surface, the reflected light has the same spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

The environment in which the image data are generated is not pristine. Several sources of noise exist in this scenario and should be addressed in the registration process. For one, alignment of the printheads can deviate from an expected position significantly, especially when different types of imaging surfaces are used or when printheads are replaced. Additionally, not all inkjets in a printhead remain operational without maintenance. Thus, a need exists to continue to register the heads before maintenance can recover the missing jets. Also, some inkjets are intermittent, meaning the inkjet may fire sometimes and not at others. Inkjets also may not eject ink perpendicularly with respect to the face of the printhead. These off-angle ink drops land at locations other than were they are expected to land. Some printheads are oriented at an angle with respect to the width of the image receiving member. This angle is sometimes known as printhead roll in the art. The image receiving member also contributes noise. Specifically, structure in the image receiving surface and/or colored contaminants in the image receiving surface may be confused ink drops in the image data and lightly colored inks and weakly performing inkjets provide ink drops that contrast less starkly with the image receiving member than darkly colored inks or ink drops formed with an appropriate ink drop mass. Thus, improvements in printed images and the analysis of the image data corresponding to the printer images are useful for identifying printhead orientation deviations and printhead characteristics that affect the ejection of ink from a printhead. Moreover, image data analysis that enables correction of printhead issues or compensation for printhead issues is beneficial.

SUMMARY

A test pattern printed by printheads in an inkjet printer enables image analysis of the test pattern that identifies positions of the printheads and the inkjets operating in the printheads. The test pattern includes a plurality of arrangements of dashes, each arrangement of dashes having a predetermined number of rows and a predetermined number of columns, each dash in a row of dashes in the arrangement of dashes being separated by a first predetermined distance and each dash in a column of dashes in the arrangement of dashes being separated by a second predetermined distance, each dash in a column of an arrangement of dashes being ejected by a single inkjet ejector in a printhead of the inkjet printer, and a plurality of unprinted areas interspersed between the plurality of arrangements of dashes.

A method that analyzes the image data of the above-described test pattern better identifies printhead orientations and printhead characteristics. The method includes identifying a position for each dash in a cluster of dashes in a plurality of arrangements of dashes corresponding to image data of a test pattern printed on an image receiving member, identifying a start position for each dash at each identified dash position, identifying an end position for each dash at each identified dash position, identifying an inkjet ejector that formed the dash at each identified dash position, identifying a printhead for each identified inkjet ejector and a position for the identified printhead, comparing the identified position for the identified printhead with an expected position, and operating an actuator to move the identified printhead in response to the identified position not being within a predetermined range about the expected position.

BRIEF DESCRIPTION OF THE DRAWINGS

The foregoing aspects and other features of a printer that generates a test pattern that better identifies printhead orientations and characteristics and that analyzes the image data corresponding to the generated test pattern are explained in the following description, taken in connection with the accompanying drawings.

FIG. 8 is a table depicting the operational status for a group of inkjet ejectors forming dashes in a cluster and a X pattern identifier and a Y1 pattern identifier that uniquely which inkjet ejectors have failed in situations where one or two inkjet ejectors have failed to eject ink.

DETAILED DESCRIPTION

Figure 1:
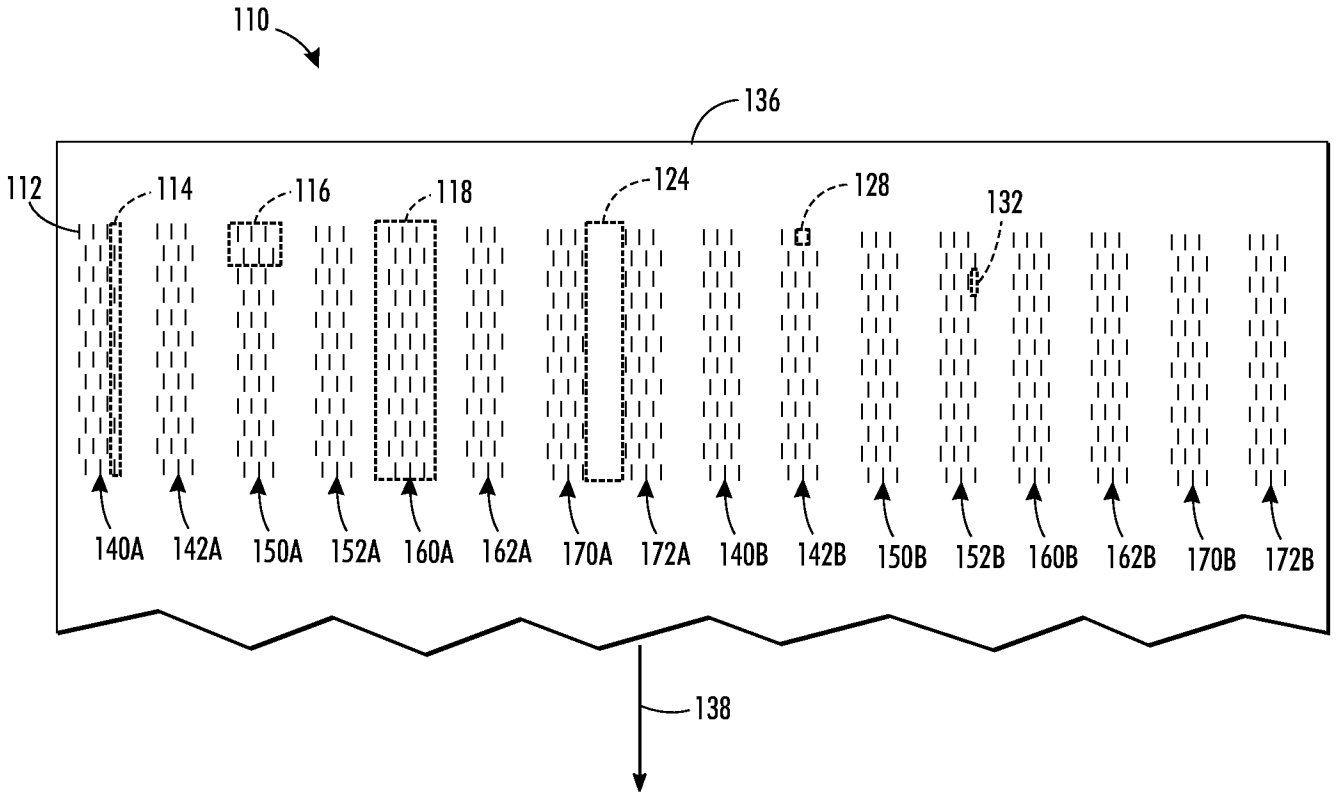
FIG. 1 is a depiction of a test pattern that useful for identifying printhead orientations and positions in an inkjet printer.

Referring to FIG. 1, a test pattern 110 includes a plurality of arrangements 118 of dashes 112 suitable for printing on an image receiving member 136, which is depicted in the figure as a sheet of paper, although the image receiving member may be a print web, offset imaging member, or the like. The image receiving member 136 moves in the process direction past a plurality of printheads that eject ink onto the image receiving member to form the test pattern 110. The test pattern arrangements 118 are separated from one another by a predetermined horizontal distance 124. Each test pattern arrangement 118 includes a plurality of clusters 116 of dashes 112. Each cluster 116 is printed by a group of inkjet ejectors in a single printhead. A printhead forming a cluster 116 of dashes 112 is operated repeatedly to print a plurality of clusters 116 to form an arrangement 118 of dashes 112. In each column, such as column 114, within an arrangement 118 of dashes 112, a predetermined distance 132 separates each dash 112 in one cluster 116 from a next dash in another cluster 116 of the arrangement 118 in the process direction. In the embodiment shown in FIG. 1, each cluster 116 has six dashes produced by six different ejectors arranged in a single printhead. Each dash 112 is formed with a predetermined number of droplets ejected by an inkjet ejector. Each cluster 116 has two staggered rows of three dashes 112 each, with a predetermined distance 128 separating the dashes 112 in a cluster 116 in the cross-process direction.

The test pattern arrangements 118 depicted in FIG. 1 are further grouped into pairs, with each pair of test pattern arrangements being generated by a different printhead ejecting the same color of ink. Multiple test pattern arrangements 118 may also be used in multi-colored printing systems, such as cyan, magenta, yellow, black (CMYK) systems. In printing systems that interlace two or more printheads that eject the same color of ink to increase the cross-process resolution and that align two or more printheads of different colors to enable color printing, adjacent test pattern arrangements 118 may be generated by printheads ejecting the same color of ink that are shifted by a distance of one-half an inkjet ejector. This shift is sometimes known as interlacing. According to the embodiment of FIG. 1, adjacent test pattern arrangements 140A and 142A are generated by two cyan ink ejecting printheads that are interlaced to increase the cross-process resolution of the cyan printing. Likewise, adjacent test pattern arrangements 140B and 142B are generated by different nozzles on the same two cyan printheads. Test pattern arrangements 140A and 140B are printed by one cyan ink ejecting printhead, while the test pattern arrangements 142A and 142B are printed by a second cyan ink ejecting printhead that is interlaced with the first cyan ink ejecting printhead. In FIG. 1, test pattern groups 150A and 150B are from a first magenta printhead while test pattern groups 152A and 152B are from a second, magenta printhead that is interlaced with the first magenta printhead. The same sequence applies for the printhead producing test pattern groups 160A and 160B and the printhead producing test pattern 162A and 162B for the color yellow. Black ink is produced by the printheads that generate test patterns 170A and 170B and 172A and 172B. The series of test pattern arrangements depicted in FIG. 1 may be repeated across the width of an image receiving member for multiple printheads.

Figure 2:
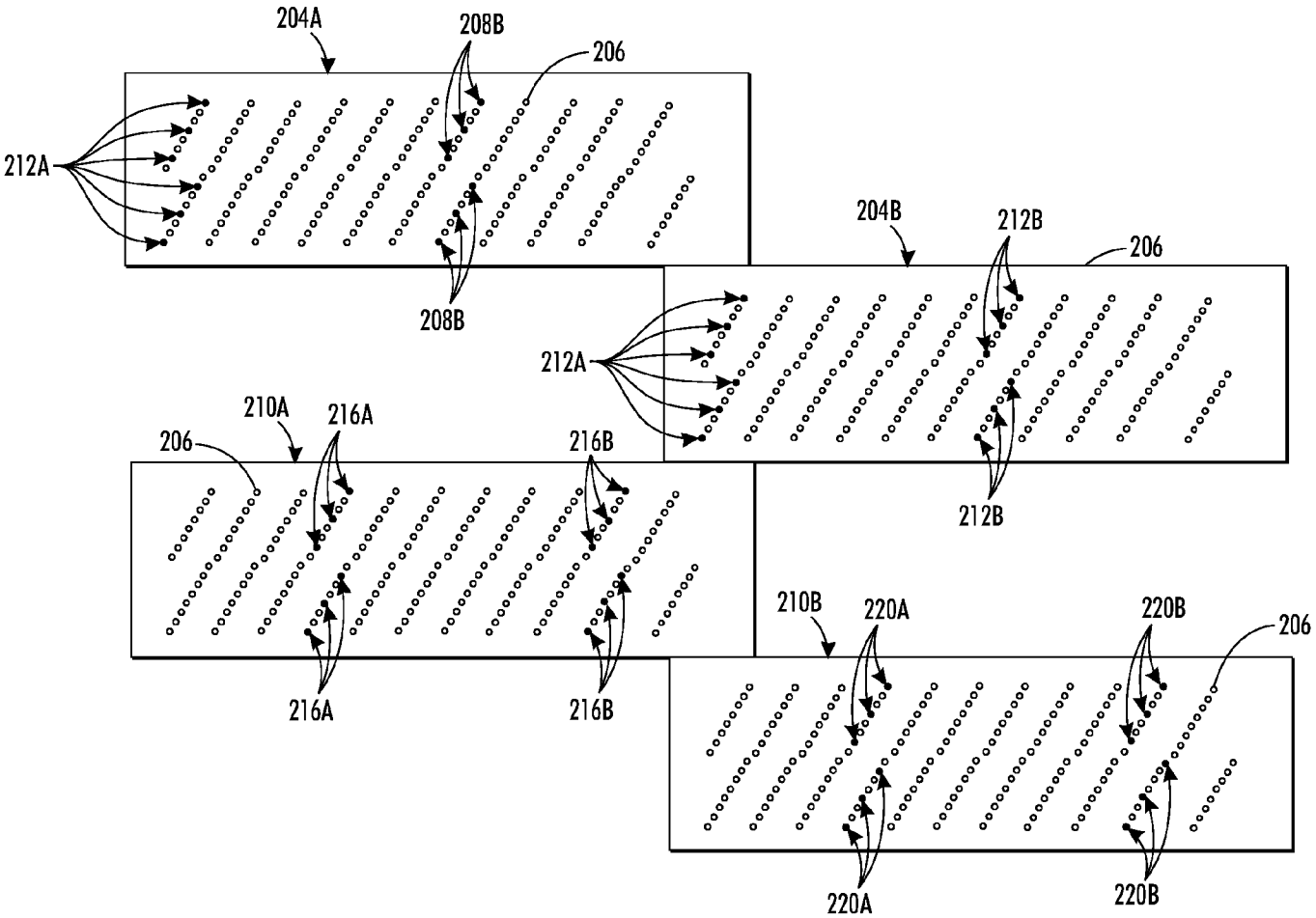
FIG. 2 is a front view of two staggered printheads.

Staggered printheads capable of printing adjacent test pattern arrangements are shown in FIG. 2. Two printheads 204A and 204B are arranged in a staggered configuration to allow inkjet ejectors 206 of each of the printheads 204A and 204B to eject ink droplets across the process at a first resolution onto an image receiving member. A second pair of printheads 210A and 210B are positioned in the process direction with respect to the printheads 204A and 204B, but these printheads are interlaced with printheads 204A and 204B. A group of the inkjet ejectors 206 in each printhead are selected to print the dashes, clusters, and arrangements for a test pattern. In printhead 204A, ejector groups 208A and 208B each include a total of six inkjet ejectors positioned on different rows of the printhead 204A. Each inkjet ejector is configured to output a predetermined number of ink drops to form a dash in a test pattern for reasons explained in more detail below.

The inkjet ejectors in the group printing a cluster of dashes are selected to facilitate detection of printhead roll, among other reasons. In the embodiment depicted, the six nozzles chosen are from rows 1,4,7,10,13, and 16 of the printhead. If the printhead is rolled counterclockwise, the cross process direction spacing between these rows decreases. If the printhead is rolled clockwise, the cross process direction spacing between these rows increases. Printing from different printhead rows enables the image data analysis to monitor whether the printhead roll exceeds specifications to an extent that degrades image registration.

Likewise, printhead 210A also has a group of ejectors 206 selected for generating dashes and clusters in a test pattern. Each of the selected groups 208A, 208B, 216A and 216B print a separate test pattern arrangement for each of printheads 204A and 210A. Staggered printheads 204B and 210B have their own ejector groups 212A, 212B, 220A and 220B capable of printing test pattern arrangements on portions of an image receiving member that are different than the portions on which the test pattern arrangements produced by printheads 204A and 210A are printed. The printheads 204A, 204B, and 210A and 210B are shorter in length than the printheads that printed the test pattern of FIG. 1 as a group of inkjet ejectors from each printhead in a column of printheads is selected to print the test pattern arrangements shown in FIG. 1. In a CMYK printer, the space between ejector groups in the first printhead in a column of printheads need to be separated by a distance that enables the printhead interlaced with the first printhead and each pair of printheads in the column with the first printhead to print a pair of test pattern arrangements as shown in FIG. 1. The staggered printhead arrangement of FIG. 2 may be repeated laterally across the width of an image receiving member moving past the printheads. Operating these printheads in a manner similar to the one described above enables the test pattern arrangements to be printed across the width of the image receiving member. Additionally, while FIG. 2 depicts two staggered printhead arrays, alternate configurations may use three or more arrays with varying degrees of offset to provide different print resolutions.

Figure 3:
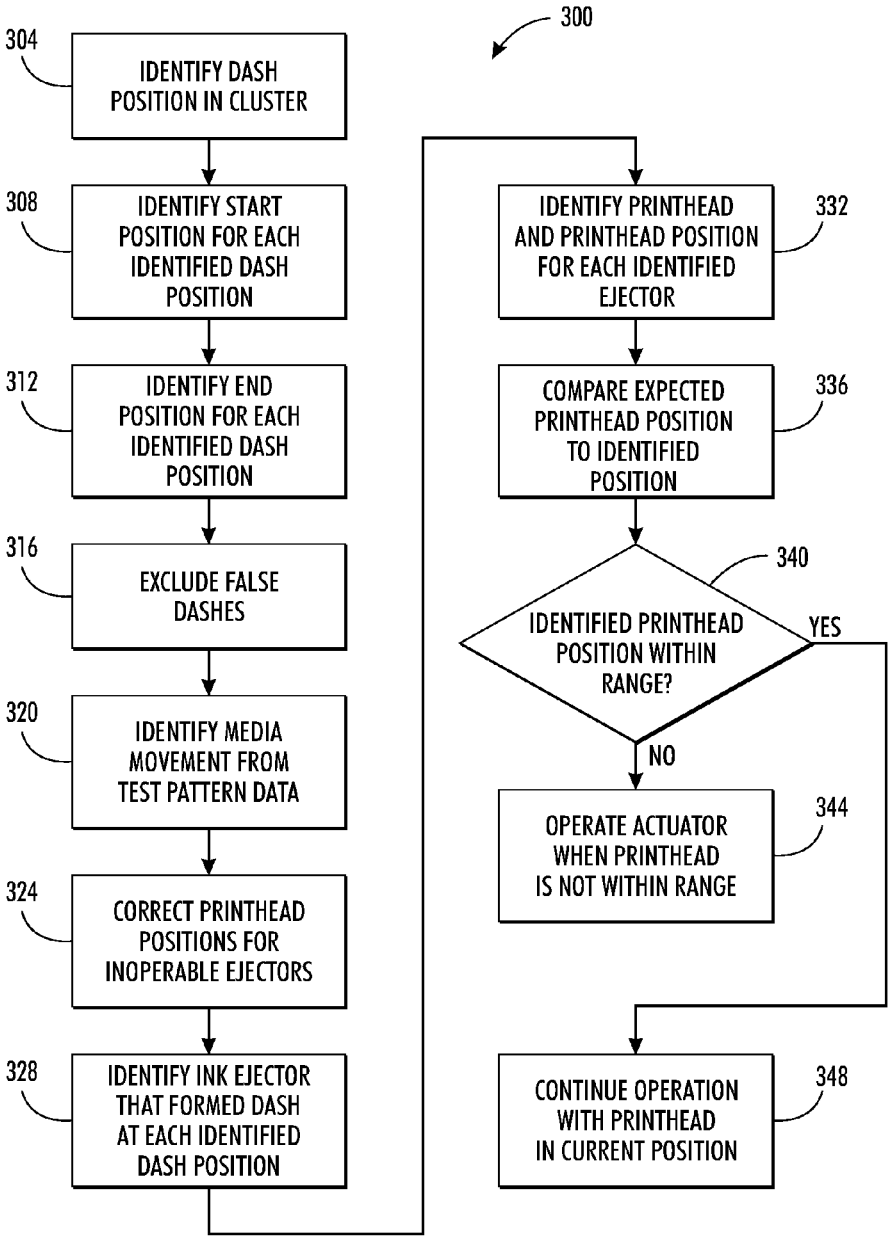
FIG. 3 is a block diagram of a method for identifying printhead orientations and positions suitable for use with the test pattern of FIG. 1.

A block diagram of a process 300 for analyzing image data corresponding to test patterns printed on an image receiving member and adjusting the position of the printheads in response to the analysis of the image data is depicted in FIG. 3. A printing device includes a controller or other processor that is communicatively coupled to a memory in which instructions and data are stored that configure the controller to perform the process or one similar to the process shown in FIG. 3. The image data corresponding to a test pattern printed on an image receiving member may be generated by an optical sensor. The optical sensor may include an array of optical detectors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

The ability to differentiate dashes of different ink colors is subject to the phenomenon of missing or weak inkjet ejectors. Weak inkjet ejectors are ejectors that do not respond to a firing signal by ejecting an amount of ink that corresponds to the amplitude or frequency of the firing signal delivered to the inkjet ejector. A weak inkjet ejector, instead, delivers a lesser amount of ink. Consequently, the lesser amount of ink ejected by a weak jet covers less of the image receiving member so the contrast of the signal generated by the optical detector with respect to the ink receiving member is lower. Therefore, ink drops in a dash ejected by a weak inkjet ejector may result in an electrical signal that has a magnitude close to the magnitude of an appropriately sized ink drop ejected by an inkjet ejector ejecting a lighter colored ink. Missing inkjet ejectors are inkjet ejectors that eject little or no ink in response to the delivery of a firing signal. A process for identifying the inkjet ejectors that fail to eject ink drops for the test pattern is discussed in more detail below.

The controller is configured with programmed instructions and data stored in a memory to operate the printheads and generate the test pattern of FIG. 1 on an image receiving member. The length of the dashes corresponds to the number of drops used to form a dash. The number of drops is chosen to produce a dash that is sufficiently greater in length than the resolution of the optical detector in the process direction. The distance imaged by an optical detector is dependent upon the speed of the image member moving past the detector and the line rate of the optical detector. A single row of optical detectors extending across the width of the imaging area on the image receiving member is called a scanline in this document. The dashes are generated with a length that is greater than the imaging area of a scanline in the process direction so the dash image can be resolved in the image processing. The dash is also chosen to be short enough to enable many repetitions of the dashes so multiple measurements of dashes produced by the same inkjet ejector can be printed. These multiple measurements enable differences arising from the performance of the inkjet ejector to be averaged so the measurements can be rendered more precisely. In one embodiment, the dashes are formed from an inkjet ejector being operated to eject a series of twenty ink drops.

The length of the dashes and the distance separating the dashes also provide noise immunity from structure in the image receiving member that may respond as ink does to the light directed towards the image receiving member. These structures do not appear in the image receiving member with the periodicity that the dashes do. This difference in behavior can be used to distinguish structure in the image receiving member from the dashes in the test pattern. Other sources of image data noise include a backer roller over which the image receiving member may roll as it is illuminated by the light source. Wobble in the rotation of the backer roller may introduce inaccuracy in the positional information obtained from the image data corresponding to the test pattern on the image receiving member. Repeating the dashes over a distance that is a multiple of the circumference of the backer roller enables the wobble to be averaged out of the measurements.

As shown in FIG. 1, the dashes in the clusters are arranged in a staggered order. The staggering serves two purposes. First, staggering the dashes minimizes optical cross talk between adjacent inkjet ejectors. That is, the position of a dash in a cluster is not likely to be affected by the presence of an adjacent dash. Second, staggering enables the measurements for the dashes in the cluster to be used to identify one or more of the inkjet ejectors in the group that fail to print. The use of cluster dash measurements is described in more detail below.

Figure 4:
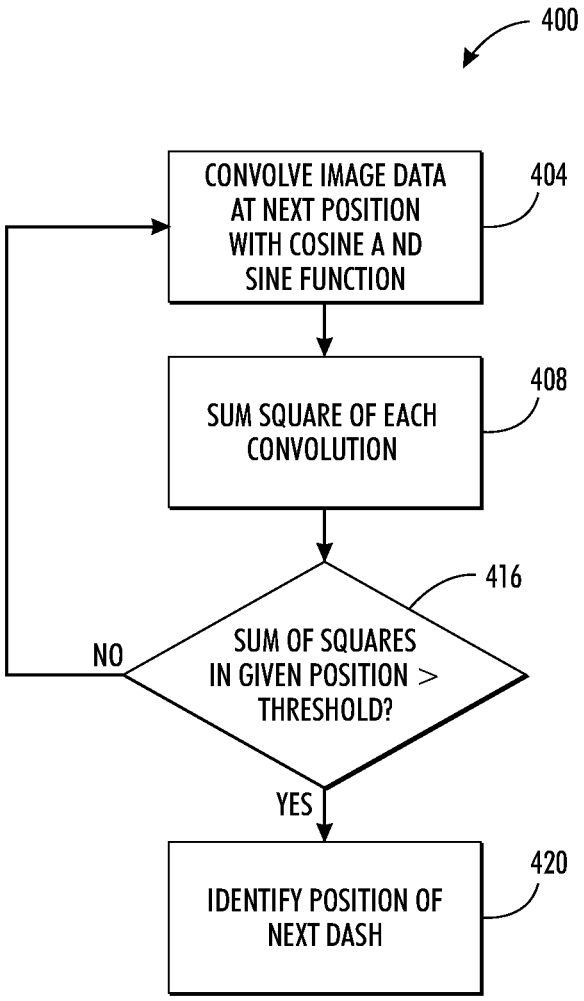
FIG. 4 is a flow diagram of a process for identifying the position of a column of dashes in a test pattern.

The process 300 begins with identification of the positions of dashes in column of a test pattern arrangement (block 304). The identification of these positions is obtained by generating a magnitude versus time profile for each optical detector in the optical detector array. This profile is analyzed by the process 400 depicted in FIG. 4. Two convolution operations are performed on image data acquired from a single optical detector. In one convolution, the profile is convolved with a sine function and, in the other convolution, the profile is convolved with a cosine function (block 404). These functions have a periodicity corresponding with the periodicity of the dashes in a test pattern arrangement in the process direction. As used in this document, "convolution" refers to the summation of the product of two functions. Thus, the summation of the product of the profile function and sine function is computed and the summation of the product of the profile function and cosine function is computed. The squares of the magnitudes of these two convolutions are then added to produce a sum (block 408). This sum is compared to a predetermined threshold value, and if the sum exceeds the threshold (block 416), then the position is identified as containing a dash (block 420). If the sum does not exceed the threshold (block 416) the process at the next portion of the profile to determine whether a dash is present at the next position (block 404).

Returning to the process 300 of FIG. 3, the position identification process for a dash may also include steps to identify the starting position for each detected dash (block 308). The start position may be detected using a convolution operation that convolves the image profile data with a start edge detecting kernel function known to the art. As used in this document, "start edge kernel" refers to a function that is defined so the convolution of the dash profile and the start edge kernel function is a minimum at the start of a dash in a column in the process direction. The convolution with the start kernel identifies a local minimum where the start position of dash occurs on the portion of the image receiving member underlying the optical detector. Similarly, the end position of each dash may be identified by a convolution with an end edge detection kernel (block 312). The end edge kernel is the inverse of the start edge kernel.

Figure 5:
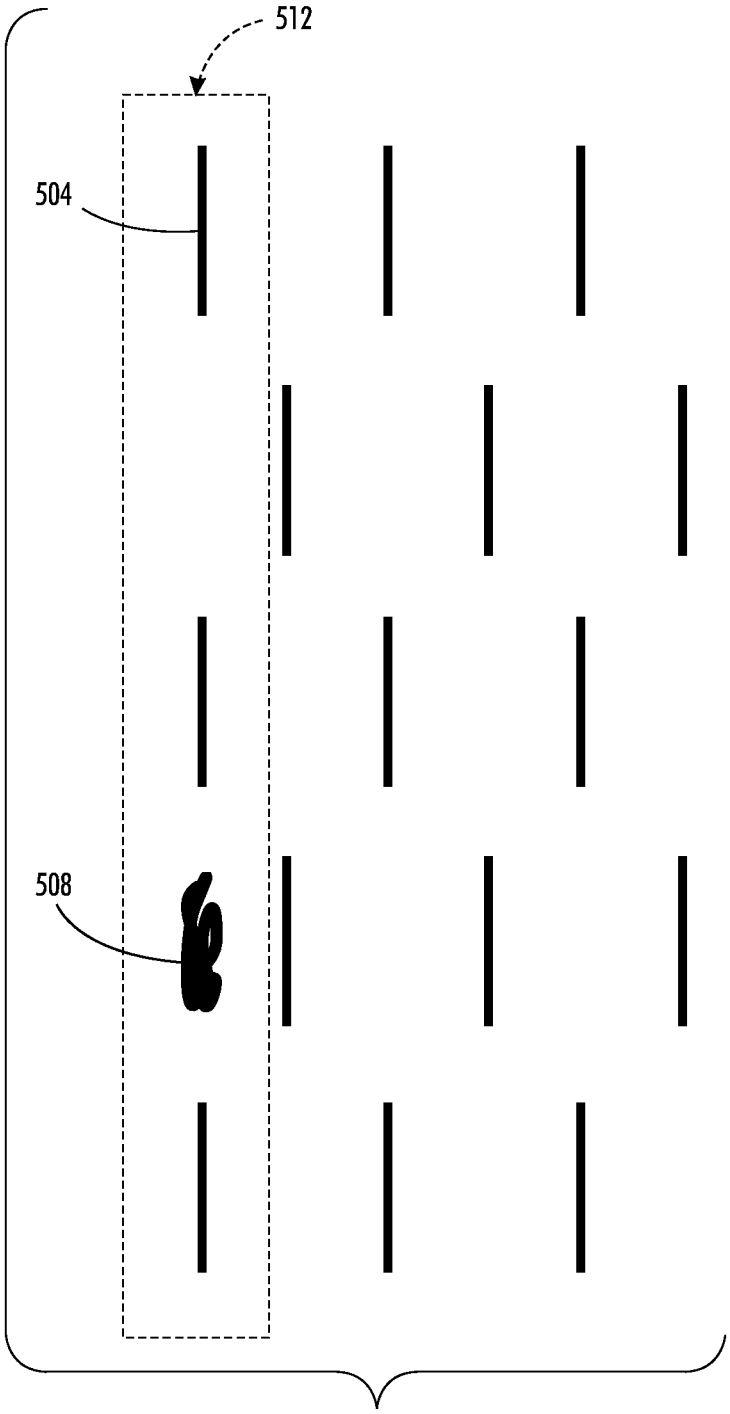
FIG. 5 is a depiction of a portion of a test pattern including a contaminant.

In some cases, the process 300 of FIG. 3 may detect a dash where no dash is present. Various noise sources, including discolored spots on the image receiving member or contaminants that adhere to the image receiving member may give the false appearance of a dash. An example of a contaminant is depicted in FIG. 5. In FIG. 5, clusters of dashes 504 include contaminant 508 which is in line with a column of dashes 512. The contaminant 508 resembles a test pattern dash closely enough to be detected as one by the method of FIG. 4 described above. In the process of FIG. 3, the contaminant may be excluded from the test pattern (block 316) using the process 600 of FIG. 6.

Figure 6:
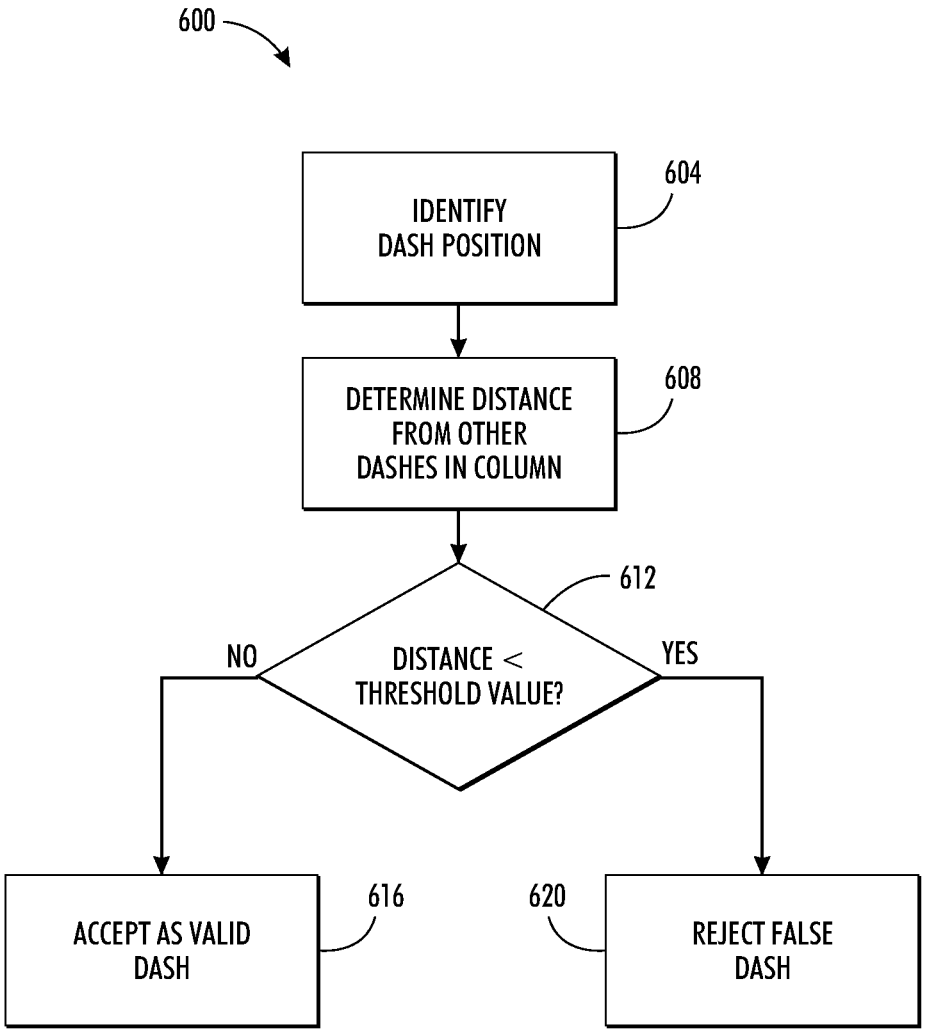
FIG. 6 is a flow diagram of a process for analyzing image data to in order to ignore incorrectly detected dashes from the test pattern.

In order to exclude false dashes, the process 600 of FIG. 6 begins with the identified position of a dash (block 604), already obtained from the process 300 at block 304. The position of the dash is then compared to the positions of one or more dashes already detected in the same column to determine the distance from the dash being analyzed to the dash positions previously evaluated (block 608). Since the expected distance between dashes in each column is known before the test pattern arrangements including the dashes are printed, the predetermined distance between the dashes is a threshold distance useful for detecting false dashes. If the position of the dash being analyzed is within an acceptable range for the predetermined distances from the other evaluated dashes in the cluster of the test pattern (block 612), the dash position identification is accepted (block 616). However, if the distance between the dash being analyzed and the previously evaluated dashes in a column is too short (block 612), then the dash being analyzed is deemed to be noise and is rejected (block 620).

Again referring to FIG. 3, the process 300 continues by examining the image data acquired from the test pattern arrangements for media movement (block 320). During the printing of the test patterns used for printhead registration, the image receiving member may shift in the cross-process direction while the test pattern is printed. If the image receiving member is a media web such as a paper web, the web may vibrate as the web passes through the printer. These extraneous movements change the positions of dashes made in the test pattern. The calculated distances between the dashes can be used to measure the motion of the media caused by vibration. The process in FIG. 4 can be used to refine the determination of the dash position in the cross process direction further. The largest response of the convolution occurs for the optical detector pixel closest to the dash center. However, the adjacent optical detector pixels also respond to the presence of the dash and each pixel gives a slightly smaller response. These three responses are used as three points to which a curve is fitted. The curve is then used to compute a local minimum to identify more precisely the center of the dash in the cross process direction. In one embodiment, the curve is a curve corresponding to a quadratic function. Through repeated distance measurements using the detected positions of dashes in a cluster, the average expected row and column distances between the centers of the dashes may be obtained by process 300. Temporary deviations from these distances indicate vibration or other undesirable movement in the image receiving member. Identifying these deviations enables the deviations arising from movement in the image receiving member to be removed from the image data corresponding to the test pattern on the image receiving member in further analysis.

Figure 7:
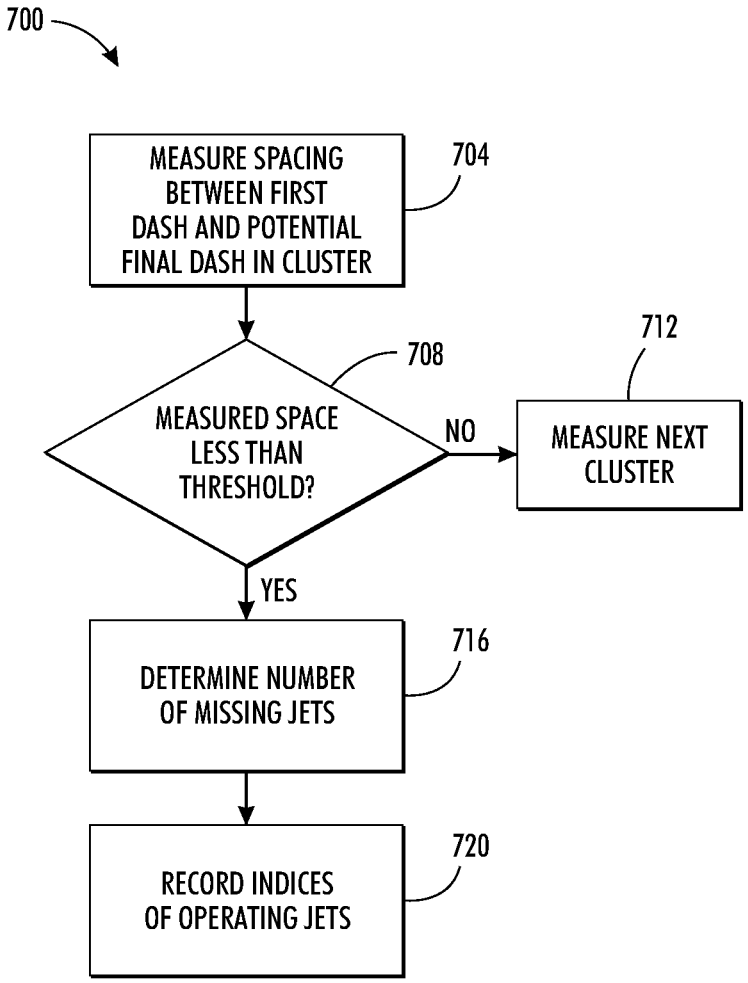
FIG. 7 is a flow diagram of a process for analyzing image data to identify inoperable inkjet ejectors in a printhead as well as the positions and orientations of the printheads.

During printing of test pattern arrangements, one or more of the inkjet ejectors may fail to eject ink droplets properly and cause blank areas to appear where a dash should be. These errors are detected for the remaining inkjets and used to estimate the position of the printheads (block 324). A method for detecting and compensating for inoperable inkjet ejectors in a test pattern is shown in FIG. 7. The process 700 of FIG. 7 begins by measuring a distance between a first detected dash in a cluster and the last detected dash in the cluster (block 704). An example of how dashes may be arranged in a cluster is depicted in FIG. 8. The cluster 804 has six dashes with the dashes in the first row being designated as being in a "High" row, since that row is above the other row in the cluster; and the dashes in the second row being designated as being in a "Low" row, since that row is below the first row in the cluster. The dash positions in the High row are numbered using odd numbers, namely, $H_1$, $H_3$, and $H_5$, and the das positions in the Low row are numbered using even numbers, namely, $L_2$, $L_4$, $L_6$. The first detected dash is the dash with the lowest subscript number (1-6) that is successfully printed in the test pattern, and the final detected dash is the dash with the highest subscript number (1-6). In order to determine if any ejectors are inoperable, the distance between the first detected dash and the last detected dash is measured (block 704). If this distance is found to be substantially less than the distance 124 (FIG. 1) that separates clusters of dashes in different test pattern arrangements 118 (block 708), then all of the ejectors in the cluster are operational (block 712). However, if the measured distance is similar to the inter-cluster distance 124, then some or all of the ejectors are missing (block 716). The locations and relative positions of the operational ejectors are recorded and used to encode the patterns of working and missing ejectors in the cluster (block 720).

The result from the process 700 of FIG. 7 allows for the accurate use of test patterns whenever a single ejector is inoperable, or in nearly all occasions when two ejectors are inoperable. Each ejector cluster is encoded with two identifiers. The first identifier indicates the cross process direction spacing between ejectors in a cluster. One form of encoding this information is to list a series of numbers, with a "0" meaning two detected adjacent ejectors are positioned at their expected spacing, and a number N greater than zero indicating that N ejectors are missing from two adjacent detected ejectors in the cluster. For example, in a staggered cluster of six ejectors with two rows, if all ejectors are operational, the first encoding returns 00000, while in a cluster with the fourth and sixth ejectors missing, the encoding returns 001. The above encodings are represented in a reduced canonical form known to the art, with a cluster of six ejectors representing all ejectors functioning using five digits, while a cluster with one missing ejector uses four digits, and a cluster with two missing ejectors uses three digits. The second identifier lists the relative positions of operational ejectors including which row each operational ejector belongs to. For example, using a test pattern with six ejectors in two rows, where "H" is the High row and "L" is the low row, a fully operational ejector would have a second code of HLHLHL, and a cluster with the final two ejectors missing from the low row would be HLHH.

Combining both the first and second identifiers above to identify the dashes in a detected cluster, the printer may identify the positions of all operational and non-operational ejectors in a cluster, including situations where some ejectors may be non-operational. In an example embodiment with ejectors configured to form dashes in two staggered rows of three ejectors each, the first and second identifiers may uniquely identify all configurations of ejectors where one ejector is inoperable. If two ejectors are inoperable, then of the fifteen possible permutations of ejector configurations, the first and second identifiers can uniquely identify all configurations of inoperable ejectors except for ejector pairs depicted in FIG. 8. In FIG. 8, the first six columns include a number indicating the inkjet ejector that formed a dash in a cluster. Inkjet ejectors 1, 3, and 5 form the dashes in the first row of a cluster and inkjet ejectors 2, 4, and 6 form the dashes in the second row. The binary values under the inkjet ejector identifiers indicate whether the inkjet ejector formed a dash ("1") or not ("0"). The X pattern indicates the cross-process direction spacing between dashes in a cluster described above. The Y1 pattern indicates the positions of the dashes in a cluster formed by the inkjet ejectors. As shown in FIG. 8, the pattern formed when each inkjet ejector forms a dash in a cluster and the patterns formed when only one inkjet ejector fails to form a dash can be uniquely identified by the X pattern and Y1 pattern values. When two inkjet ejectors fail to form a dash, however, the Y1 pattern HLHL occurs in four situations. Two of those situations have a unique X pattern as shown in the figure. Specifically, the X patterns 002 and 020 uniquely identify the two inkjet ejectors that failed to eject ink to form a dash in the cluster. When the inkjet ejectors 1 and 2 or the inkjet ejectors 5 and 6 fail to operate, the Y1 pattern and the X pattern are the same. Thus, the system is unable to differentiate between these two conditions and cannot identify the two inkjet ejectors that failed to eject ink. Statistically, this situation is unlikely to occur with a frequency that warrants further refinement of the image analysis and the image analysis proceeds with information that two inkjet ejectors have failed along with identifying information for the four candidates. For situations where three or more inkjet ejectors fail to eject ink, the image analysis is terminated and an indication that the printhead should be replaced is generated as the clustering of three or more non-operational inkjet ejectors warrants replacement of the printhead.

While an embodiment has been described that performs image analysis capable of identifying a single failed inkjet ejector or two inkjet ejectors in all but two cases, the image analysis could be generalized for further extension. For example, a cluster have more than two rows could be produced by a larger group of inkjet ejectors and the positions of the dashes could be identified with more indicators than H and L. For example, three rows could use H, L, and M (for middle) positional indicators to refine the missing inkjet ejector positional analysis. Thus, the process direction staggering and the cross process direction spacing may be adapted to other cluster dash patterns and larger groups of inkjet ejectors.

Referring again to the flow diagram of FIG. 3, the printer uses the identified clusters, including clusters with inoperable ejectors, to identify each ejector that formed a dash in the test pattern clusters (block 328). Each detected cluster can be associate with an index as illustrated in FIG. 1 and its position can be associated with the printhead that jetting the cluster (block 332).

Following identification of the ink ejectors and printheads, the detected positions of dashes in each test pattern are compared to the expected positions of dashes that would be generated by a properly aligned printhead (block 336). To account for variances in ejector output, the test pattern arrangements use multiple clusters of dashes, and the positions of each dash may be used to estimate more accurately the difference between the actual position of the printhead and the target position of the printhead. If the difference between the detected printhead position and the expected position is within a predetermined range (block 340), the printhead may continue in operation (block 348). If the printhead is found to be misaligned beyond the acceptable threshold (block 340), then one or more actuators may be used to reposition the printhead (block 344). The actuators adjust the position of the entire printhead for coarse registration of the ink ejectors in the printhead to be within the predetermined tolerance for acceptable initialization of printheads in the startup operation of a printer. Finer registration and alignment of the printheads may be obtained using other methods once the coarse registration and alignment has been achieved.

Figure 9:
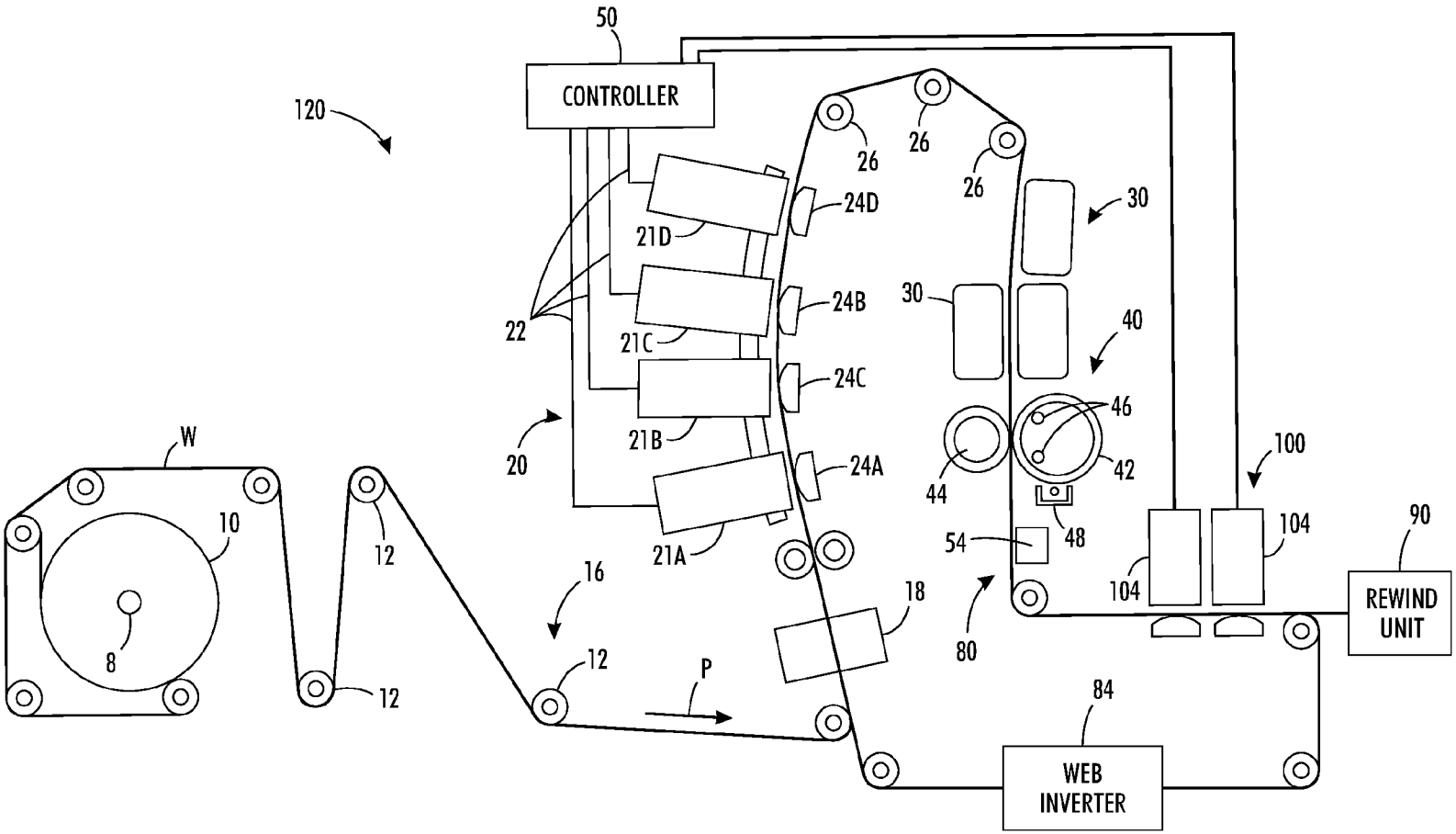
FIG. 9 is a schematic view of a prior art inkjet imaging system that ejects ink onto a continuous web of media as the media moves past the printheads in the system.

Referring to FIG. 9, a prior art inkjet imaging system 120 is shown. For the purposes of this disclosure, the imaging apparatus is in the form of an inkjet printer that employs one or more inkjet printheads and an associated solid ink supply. However, the test pattern and methods described herein are applicable to any of a variety of other imaging apparatus that use inkjets to eject one or more colorants to a medium or media. The imaging apparatus includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

FIG. 9 is a simplified schematic view of a direct-to-sheet, continuous-media, phase-change inkjet imaging system 120, that may be modified to generate the test patterns and adjust printheads using the methods discussed above. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 100, and rewind unit 90. For duplex operations, the web inverter 84 is used to flip the web over to present a second side of the media to the printing station 20, printed web conditioner 80, and coating station 100 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 100 before being flipped by the inverter 84 and laterally displaced by a distance that enables the web to travel over the other half of the rollers opposite the printing station 20, printed web conditioner 80, and coating station 100 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of printhead modules 21A, 21B, 21C, and 21D, each printhead module effectively extending across the width of the media and being able to place ink directly (i.e., without use of an intermediate or offset member) onto the moving media. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjet ejectors in the printheads to enable the four colors to be ejected with a reliable degree of accuracy for registration of the differently color patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a printhead module for each primary color may include one or more printheads; multiple printheads in a module may be formed into a single row or multiple row array; printheads of a multiple row array may be staggered; a printhead may print more than one color; or the printheads or portions thereof can be mounted movably in a direction transverse to the process direction P, such as for spot-color applications and the like.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each printhead module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 9, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 100 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 100 may apply the clear ink with either a roller or a printhead 104 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 120 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The imaging system 120 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CODs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Figure 10:
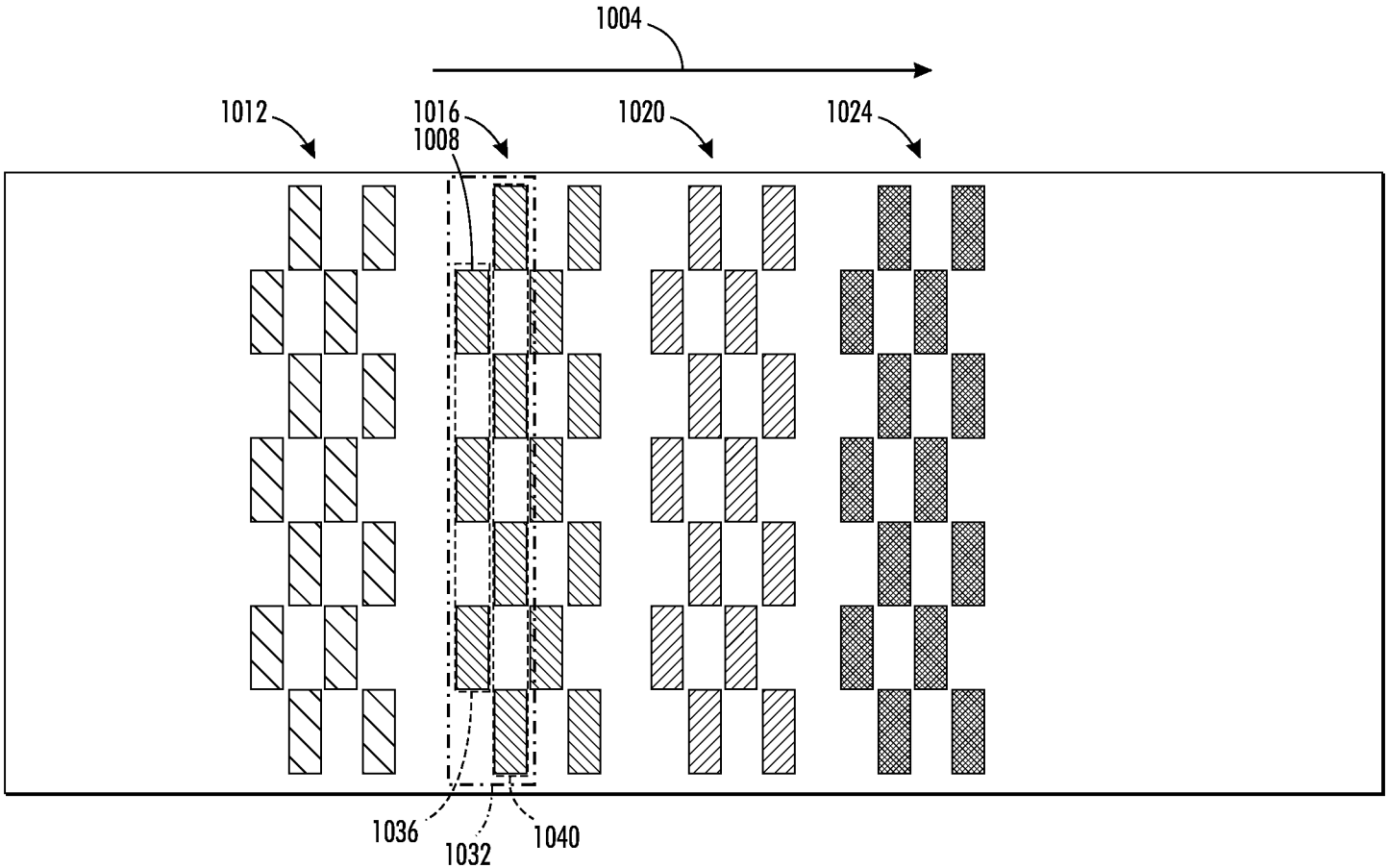
FIG. 10 PRIOR ART
FIG. 10 is a schematic view of a prior art printhead configuration.

A schematic view of a prior art print zone 1000 that may be modified to use the test patterns described above is depicted in FIG. 10. The print zone 1000 includes four color units 1012, 1016, 1020, and 1024 arranged along a process direction 1004. Each color unit ejects ink of a color that is different than the other color units. In one embodiment, color unit 1012 ejects cyan ink, color unit 1016 ejects magenta ink, color unit 1020 ejects yellow ink, and color unit 1024 ejects black ink. The process direction is the direction that an image receiving member moves as travels under the color unit from color unit 1012 to color unit 1024. Each color unit includes two print arrays, which include two print bars each that carry multiple printheads. For example, the printhead array 1032 of the magenta color unit 1016 includes two print bars 1036 and 1040. Each print bar carries a plurality of printheads, as exemplified by printhead 1008. Print bar 1036 has three printheads, while print bar 1040 has four printheads, but alternative print bars may employ a greater or lesser number of printheads. The printheads on the print bars within a print array, such as the printheads on the print bars 1036 and 1040, are staggered to provide printing across the image receiving member in the cross process direction at a first resolution. The printheads on the print bars within the print array 1032 within color unit 1016 are interlaced with reference to the printheads in the print array 1032 to enable printing in the colored ink across the image receiving member in the cross process direction at a second resolution. The print bars and print arrays of each color unit are arranged in this manner. One printhead array in each color unit is aligned with one of the printhead arrays in each of the other color units. The other printhead arrays in the color units are similarly aligned with one another. Thus, the aligned printhead arrays enable drop-on-drop printing of different primary colors to produce secondary colors. The interlaced printheads also enable side-by-side ink drops of different colors to extend the color gamut and hues available with the printer.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer having a test pattern printed by a plurality of printheads in the inkjet printer that enables printhead position analysis from image data of the test pattern comprising:

a controller configured with programmed instructions to operate the plurality of printheads in the inkjet printer to form a test pattern on an ink image receiving surface that is positioned within the inkjet printer;

the test pattern on the ink receiving surface including a plurality of arrangements of dashes on the ink image receiving surface, each arrangement of dashes having a predetermined number of rows and a predetermined number of columns, each row of dashes having at least two dashes and each dash in a row of dashes within an arrangement of dashes being separated from each adjacent dash in the row by a same first predetermined distance in a cross-process direction, and each column of dashes having at least two dashes and each dash in a column of dashes in the arrangement of dashes being separated from an adjacent dash in the column of dashes by a second predetermined distance, each dash in a column of an arrangement of dashes being ejected by a single inkjet ejector in a printhead of the inkjet printer, a plurality of unprinted areas on the ink image receiving surface, each unprinted area separating adjacent arrangements of dashes;

an optical sensor positioned within the inkjet printer opposite the ink receiving surface to generate image data of the dashes in the plurality of arrangements of dashes on the ink receiving surface; and the controller being operatively connected to the optical sensor to identify positional data about the dashes in the plurality of arrangements with reference to the image data received from the optical sensor.

2. The inkjet printer of claim 1, each arrangement in the test pattern further comprising:

a plurality of clusters of dashes, each cluster of dashes having a predetermined number of dashes.

3. The inkjet printer of claim 2, the predetermined number of dashes in each cluster of dashes on the ink receiving surface being configured in two rows, the dashes in one row being offset in the cross-process direction from the dashes in the other row by a distance that is one-half of the same first predetermined distance.

4. The inkjet printer of claim 3, each dash in the predetermined number of dashes for a cluster of dashes on the ink receiving surface being formed by a different inkjet ejector in a single printhead, each inkjet ejector being separated by at least the first predetermined distance in the cross-process direction from the other inkjet ejectors that ejected ink in another dash in the cluster.

5. The inkjet printer of claim 4, a pair of arrangements in the plurality of arrangements on the ink receiving surface being formed with a single printhead that is different than the single printheads used to form any of the other arrangements in the plurality of arrangements.

6. The inkjet printer of claim 1, at least some of the arrangements of dashes in the plurality of arrangements of dashes on the ink receiving surface having dashes of an ink color that are different than a color of the dashes in another arrangement of dashes in the plurality of arrangements of dashes.

7. The inkjet printer of claim 1, each dash in an arrangement of dashes on the ink receiving surface being formed with a predetermined number of ink drops ejected by the inkjet ejector used to form the dash.

8. The inkjet printer of claim 4, each dash in a cluster of dashes on the ink receiving surface being ejected from an inkjet ejector that is on a row in the single printhead different than a row of the other inkjet ejectors that were used to form a dash in the cluster.

9. The inkjet printer of claim 1, each arrangement of dashes on the ink receiving surface having multiple clusters of dashes formed by a predetermined group of inkjet ejectors in a single printhead.

10. The inkjet printer of claim 1, each arrangement in a pair of arrangements adjacent one another in a cross-process direction on the ink receiving surface being formed with a pair of printheads, each printhead ejecting an ink of a same color and the two printheads being interlaced by a distance of one-half an inkjet ejector.

11. A method of operating inkjets in a plurality of printheads in an inkjet printer comprising:

transporting an ink image receiving surface in a process direction past a plurality of printheads; and operating the inkjets in the plurality of printheads with a controller configured with programmed instructions to form on the ink image receiving surface a plurality of arrangements of dashes ejected onto the ink image receiving surface, each arrangement of dashes being formed by a single printhead to have a predetermined number of rows and a predetermined number of columns, each dash in a row of dashes within an arrangement of dashes being separated from each adjacent dash in the row by a same first predetermined distance that corresponds to a distance in a cross-process direction between each inkjet ejector that ejected ink for a dash in a row of dashes, and each dash in a column of dashes in the arrangement of dashes being separated from an adjacent dash in the column of dashes by a second predetermined distance, each dash in a column of an arrangement of dashes being ejected by a single inkjet ejector in the single printhead of the inkjet printer that formed the arrangement of dashes in which the column of dashes is located, a plurality of unprinted areas on the ink image receiving surface, each unprinted area separating adjacent arrangements of dashes;

generating image data of the dashes in the plurality of arrangements of dashes on the ink receiving surface with an optical sensor positioned within the inkjet printer opposite the ink receiving surface; and identifying with the controller positional data about the dashes in the plurality of arrangements of dashes on the ink receiving surface with reference to the image data generated by the optical sensor.

12. The method of claim 11 further comprising:

operating the inkjets of the printheads with the controller to further form each arrangement of dashes with a plurality of clusters of dashes on the ink receiving surface, each cluster of dashes having a predetermined number of dashes.

13. The method of claim 12 further comprising:

operating the inkjets of the printheads with the controller to further form the predetermined number of dashes in two rows on the ink receiving surface, the dashes in one row being offset in the cross-process direction from the dashes in the other row by a distance that is one-half of the same first predetermined distance.

14. The method of claim 13 further comprising:

operating the inkjets of the printheads with the controller to further form each dash in the predetermined number of dashes for a cluster of dashes on the ink receiving surface with a different inkjet ejector in the single printhead forming the arrangement of dashes in which the cluster is located, each inkjet ejector being separated by at least the first predetermined distance in the cross-process direction from the other inkjet ejectors that ejected ink in another dash in the cluster.

15. The method of claim 14 further comprising:

operating a single printhead in the plurality of printheads with the controller to form a pair of arrangements in the plurality of arrangements on the ink receiving surface, the single printhead forming the pair of arrangements of dashes being different than the printheads used to form any of the other arrangements of dashes in the plurality of arrangements of dashes.

16. The method of claim 14 further comprising:

operating inkjet ejectors on different rows in the single printhead with the controller to form a cluster of dashes on the ink receiving surface, each inkjet ejector forming only one dash in the cluster of dashes.

17. The method of claim 11 further comprising:

operating a first printhead that ejects ink of a first color with the controller to form at least one arrangement of dashes in the plurality of arrangements of dashes on the ink receiving surface with ink of the first color; and operating a second printhead that ejects ink of a second color that is different than the first color with the controller to form another arrangement of dashes in the plurality of arrangements of dashes on the ink receiving surface.

18. The method of claim 11 further comprising:

operating the inkjets in the plurality of printheads with the controller to form each dash in an arrangement of dashes on the ink receiving surface with a predetermined number of ink drops ejected by the inkjet ejector used to form the dash.

19. The method of claim 11 further comprising:

operating a predetermined group of inkjet ejectors in the single printhead forming one arrangement of dashes with the controller to form the one arrangement of dashes with multiple clusters of dashes on the ink receiving surface.

20. The method of claim 11 further comprising:

operating a pair of printheads with the controller to form a pair of arrangements of dashes adjacent to one another on the ink receiving surface, each printhead in the pair of printheads ejecting an ink of a same color and the two printheads being interlaced by a distance of one-half an inkjet ejector.

* * * * *